US006857990B1

(12) United States Patent
Silva

(10) Patent No.: US 6,857,990 B1
(45) Date of Patent: Feb. 22, 2005

(54) AQUATIC TREADMILL

(75) Inventor: Antonio Augusto Dias de Figueiredo Silva, Palmital (BR)

(73) Assignee: Sahinco Industria, Comerico e Representacoes Ltda, Palmital (BR)

( * ) Notice: Subject to any disclaimer, the term of this patent is extended or adjusted under 35 U.S.C. 154(b) by 0 days.

(21) Appl. No.: 10/685,769

(22) Filed: Oct. 14, 2003

(51) Int. Cl.[7] ..... A63B 22/00
(52) U.S. Cl. ..... 482/54; 480/51
(58) Field of Search ..... 482/51, 54, 112; 119/700

(56) References Cited

U.S. PATENT DOCUMENTS 5,558,604 A * 9/1996 Hopkins ..... 482/54
5,647,826 A * 7/1997 Butler ..... 482/111
5,921,892 A * 7/1999 Easton ..... 482/54

* cited by examiner

*Primary Examiner*—Glenn E. Richmon
(74) *Attorney, Agent, or Firm*—Abelman, Frayne & Schwab

(57) ABSTRACT

An aquatic treadmill comprising a base (10) affixed to the edge (1) of a swimming pool (2), externally to the area occupied by the respective body of water (3); a structural arm (20) articulated to the base (10), in order to be selectively angularly displaced, by an arm actuator (12), between an inoperative position, elevated and external to the area occupied by the body of water (3), and an operative position, in which it is downwardly projected, so as to have a free end penetrating into the body of water (3); a chassis (30) having an end articulated to a free end of the structural arm (20), in order to be selectively angularly displaced, by a chassis actuator (50), between an inoperative position, seated against the structural arm (20), and a substantially horizontal operative position; and a support frame (40) mounted to the chassis (30) and carrying a pair of end transversal rollers (47), around which an endless belt (41) is mounted.

14 Claims, 17 Drawing Sheets

AQUATIC TREADMILL

FIELD OF THE INVENTION

The present invention refers to a treadmill to be operated submersed in a swimming pool or other body of water, in order to allow a person to perform aquatic exercises, such as walking or running, in order to maintain his/her physical condition, or for rehabilitation purposes.

BACKGROUND OF THE INVENTION

It has long been known that physical activities are important to promote and maintain good health, mainly if we consider the particularities of modern life associated with sedentary habits, inadequate nutrition, stress, and high competitiveness.

Among the physical activities recommended by health professionals we can point out the exercises performed on dry land or in exercise devices, such as treadmills, which basically comprise a support structure or chassis, carrying a belt onto which the individual can execute jogging movements.

On the other hand, the benefits obtained from the exercises performed in water are also known. Water provides an important buoyant support for the body of a person exercising in a partially submersed condition, allowing the individuals with several deficiencies, such as overweight, weakness, or with little control of the upper or lower limbs, or even of the trunk, to perform physical exercises, in order to maintain or to recover health conditions in post operative and in therapeutic treatments. The buoyant support promoted by the water and the resistance and refrigeration offered thereby promote remarkable results, without submitting the person to impacts over his/her joints. Excercising on submersed treadmills is wid the art. U.S. Pat. No. 4,576,376 describes an exercise device comprising a tank or swimming pool presenting sufficient dimensions to allow an individual to perform exercises therewithin in a partial submersed condition and on a treadmill mounted inside the tank. Forced circulation of water is provided in this device.

U.S. Pat. No. 4,938,469 describes an exercise device that comprises, basically, a tank or a swimming pool containing a certain level of water and housing a submersed treadmill. Pump means are further provided to produce forced circulation of water inside the tank.

In the constructions mentioned above, the treadmill is fixedly mounted in the interior of the tank or swimming pool. Thus, the tank or swimming pool operates exclusively and compulsorily with the treadmill.

U.S. Pat. No. 4,712,788 discloses a platform, onto which is mounted the treadmill and which only moves in the vertical direction, being displaced between a submerse operative position and an inoperative position, elevated above the water level, in order to make easy for a disabled person usually sitting on a wheelchair to enter the treadmill.

Thus, the devices for aquatic exercises of the treadmill type considered herein have the inconvenience of requiring the provision of a tank (or swimming pool) exclusively for the operation thereof, since they remain constantly mounted in a submersed operative condition, occupying a respective portion of the area of the tank (or swimming pool) in which they are installed.

These known devices, when installed in the swimming pool of a club, gymnastic center, or swimming school, for example, reduce the useful area of the swimming pools, usually making infeasible to use said pools for other aquatic activities. For this reason, the devices mentioned above are invariably associated with the provision of a specific tank or body of water for the installation of the treadmill, which requires larger space and higher investments for the installation and maintenance of one or more tanks.

OBJECTIVES OF THE INVENTION

By reason of the inconveniences above, it is an object of the present invention to provide an aquatic treadmill, which can be mounted in a pool designed for swimming and for other aquatic activities, without interfering with the area of the body of water when the latter is required to be used for other activities not related with the operation of the treadmill.

It is a more specific object of the present invention to provide an aquatic treadmill as mentioned above, which can be selectively and mechanically displaced between an operative condition, submersed in the swimming pool, and an inoperative position, in which it is upwardly displaced, away from the area occupied by the body of water of the swimming pool.

SUMMARY OF THE INVENTION

The aquatic treadmill of the present invention comprises: a base affixed to the edge of a swimming pool, external to the area occupied by the body of water; a structural arm having a mounting end articulated to the base, so as to be selectively and angularly displaced between an inoperative position, elevated and external to the area occupied by the respective body of water, and an operative position, in which it is downwardly projected, so as to have a free end penetrating into the body of water; an arm actuator, which is simultaneously articulated to the base and to the structural arm, in order to produce the angular displacement of the latter between its operative and inoperative positions; an elongated chassis, having an end articulated to the free end of the structural arm, in order to be selectively angularly displaced between an inoperative position, seated against the structural arm, and a substantially horizontal operative position, in which it is generally seated on the bottom of the swimming pool; a chassis actuator, which is simultaneously articulated to the structural arm and to the chassis, in order to produce the angular displacement of the latter between its operative and inoperative positions; and a support frame mounted to the chassis and carrying a pair of end transversal rollers, around which is mounted an endless belt.

The construction defined above allows the treadmill to be easily and rapidly taken to the submerse operative position on the bottom of the swimming pool and reconducted to its elevated operative position, in which it leaves the swimming pool completely free for other aquatic activities.

BRIEF DESCRIPTION OF THE DRAWINGS

The invention will be described below, with reference to the attached drawing, given by way of example of one way of carrying out the invention and in which.

DESCRIPTION OF THE ILLUSTRATED EMBODIMENT

As illustrated in the appended drawings, the present aquatic treadmill presents a base 10 to be seated and affixed, by any adequate means, such as screws, onto a region of the edge 1 of a swimming pool 2 containing a body of water 3 to be maintained within a predetermined level.

The base 10 may be constructed in different ways and in different materials. In the illustrated example, it takes the form of a metallic frame that is inferiorly affixed onto the edge 1 of the swimming pool 2.

Figure 7:
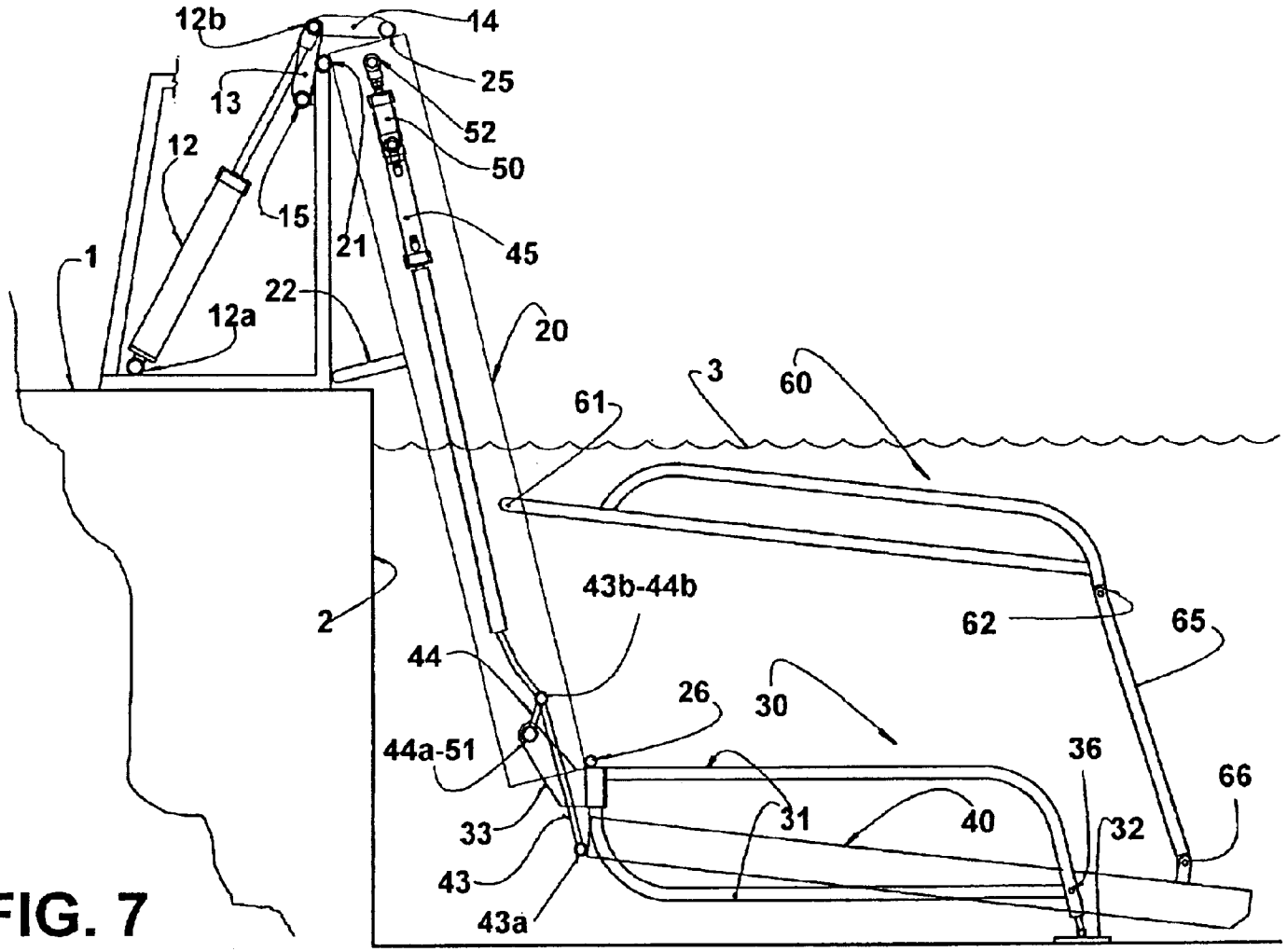
FIG. 7 is a view similar to that of FIG. 6, but illustrating the belt in a maximum inclination position.
Figure 7A:
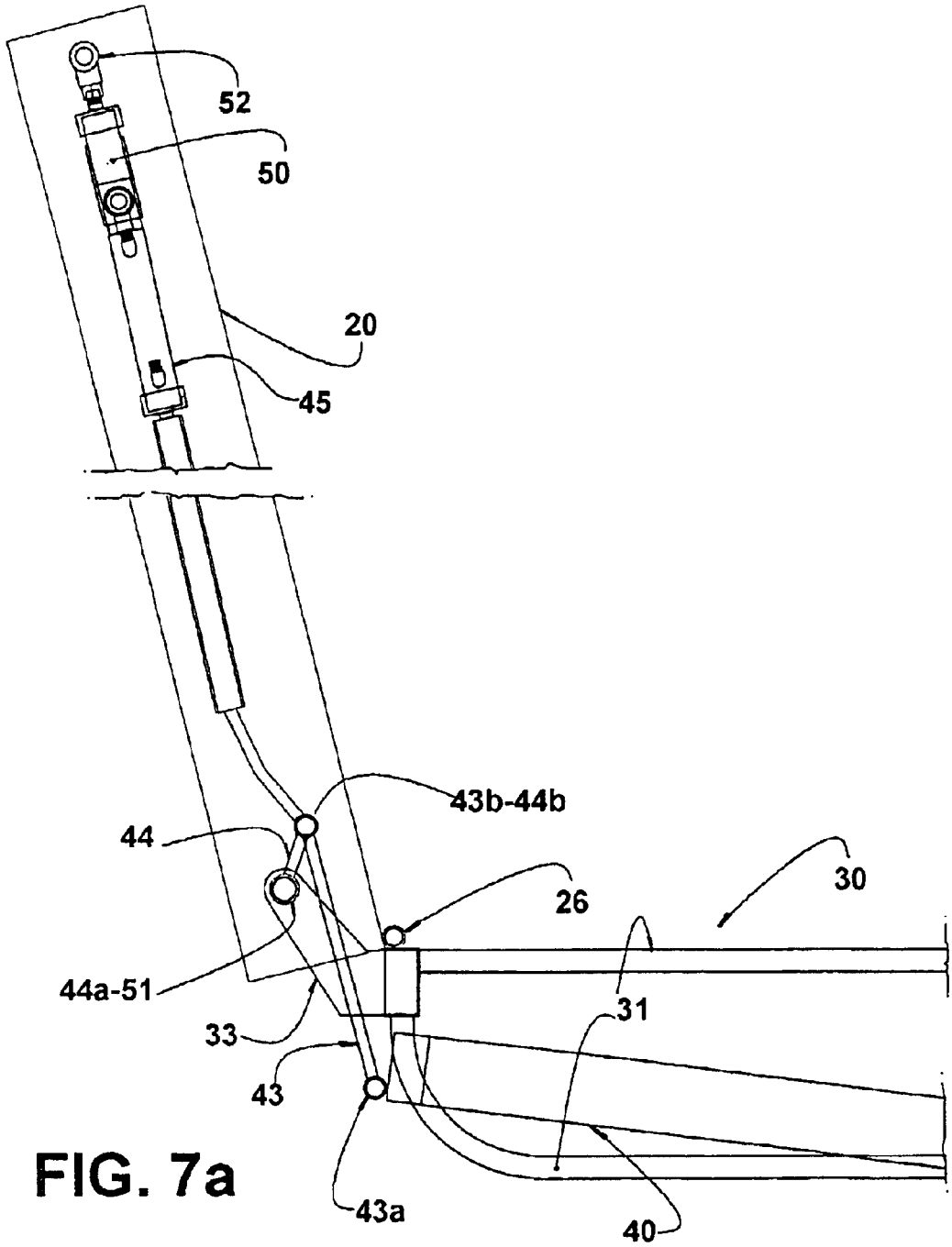
FIG. 7*a* is an enlarged lateral view of the structural arm and of part of the chassis of the treadmill, such as illustrated in FIG. 7.
Figure 7B:
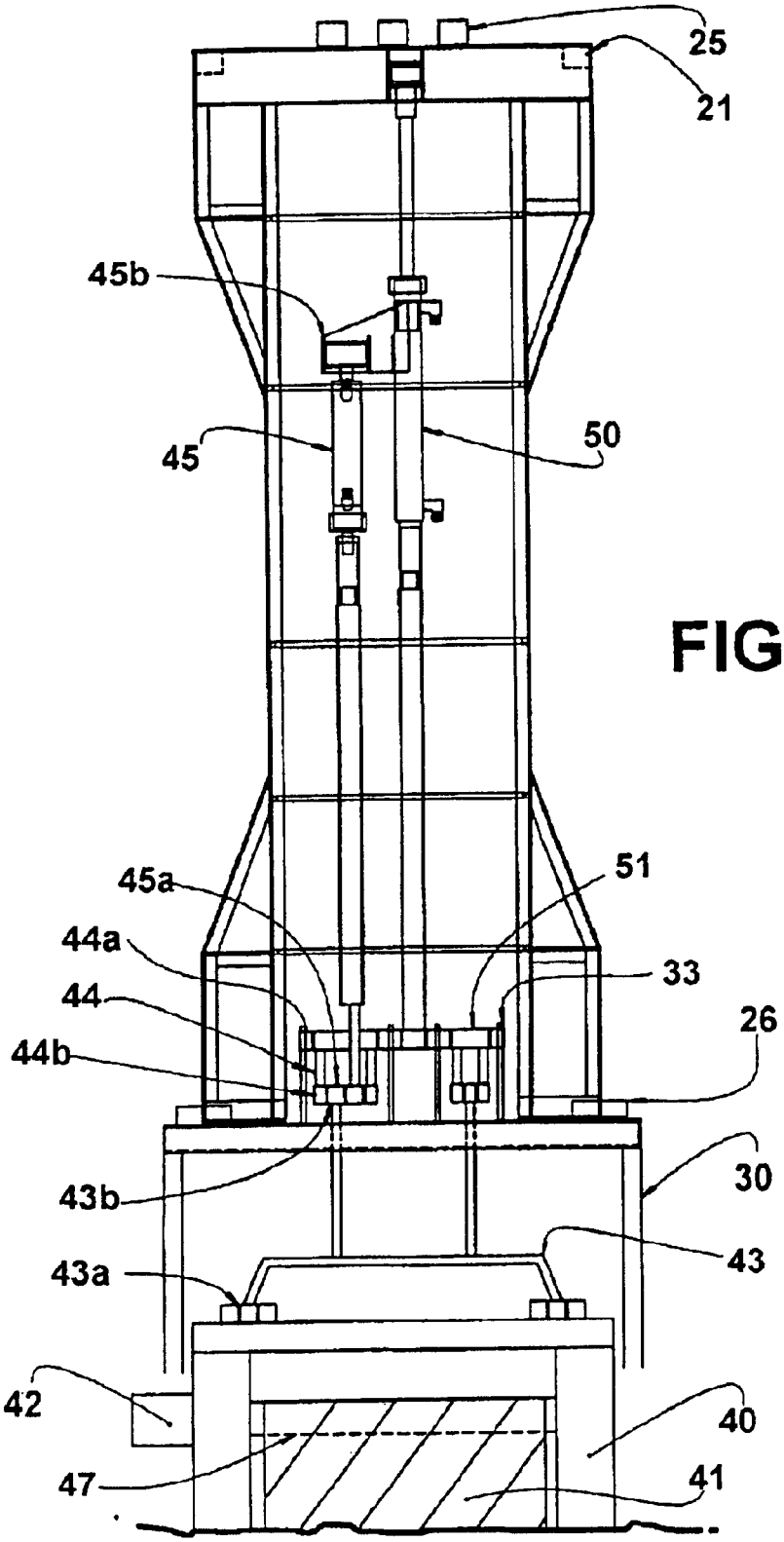
FIG. 7*b* is a rather schematic front elevational view of the structural arm illustrated in FIG. 7.

The aquatic treadmill further comprises a generally metallic structural arm 20, which is better illustrated in FIG. 7*b*, and which presents a mounting end provided with a hinge means 21 coupled to the upper region of the base 10. The hinged assembly of the structural arm 20 with the base 10 allows said structural arm 20 to be angularly displaced in about 170' around a horizontal axis, between an inoperative position, in which it is maintained elevated, substantially vertical above the base 10 and external to the area of the body of water 3 (FIG. 1), and an operative position, in which it is projected downwardly from its hinge means with the base 10, so as to have a free end penetrating into the body of water 3, as illustrated in FIG. 3.

The structural arm 20 may be medianly provided with a stop rod 22 to be seated against the base 10 when the structural arm 20 reaches its operative position, in which it is stabilized, maintaining a certain inclination. It should be understood that the hinge means 21 of the structural arm 20 may be coupled to the base 10 at a lower point and with a constructive arrangement such as to allow the structural arm 20 to remain also substantially vertical when in the operative position.

The angular movement of the structural arm 20 is achieved by an arm actuator 12, usually a hydraulic piston having an end 12*a* articulated to the lower region of the base 10, and an opposite end 12*b* articulating, simultaneously, one of the ends of a first and a second rod 13, 14, whose opposite ends are articulated to coupling means 15, 25 provided in the upper region of the base 10 and at the mounting end of the structural arm 20, respectively.

Figure 3:
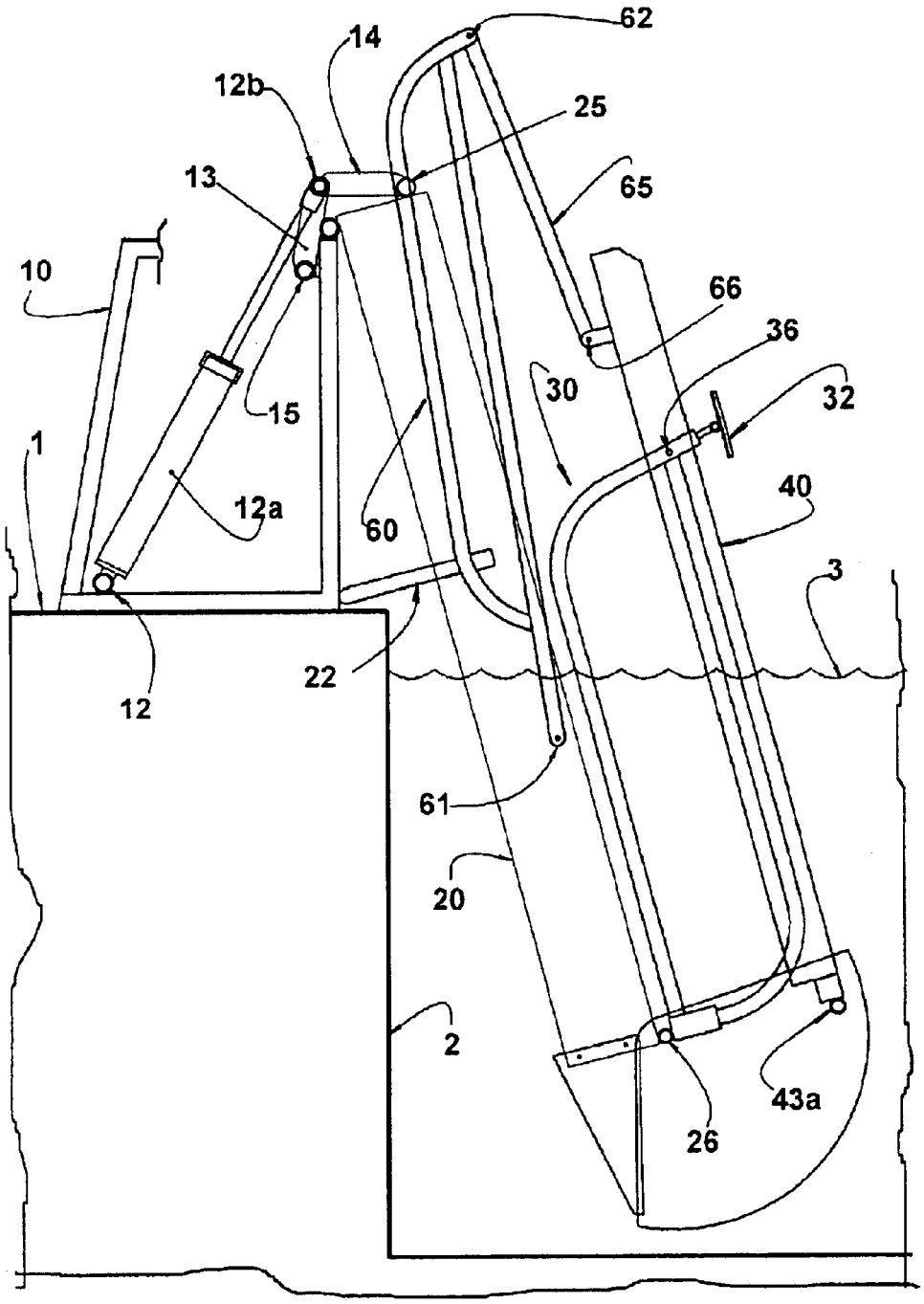
FIG. 3 is a view similar to those of the previous figures, but illustrating the structural arm of the treadmill already totally lowered to its operative position, partially submersed in the body of water.
Figure 3A:
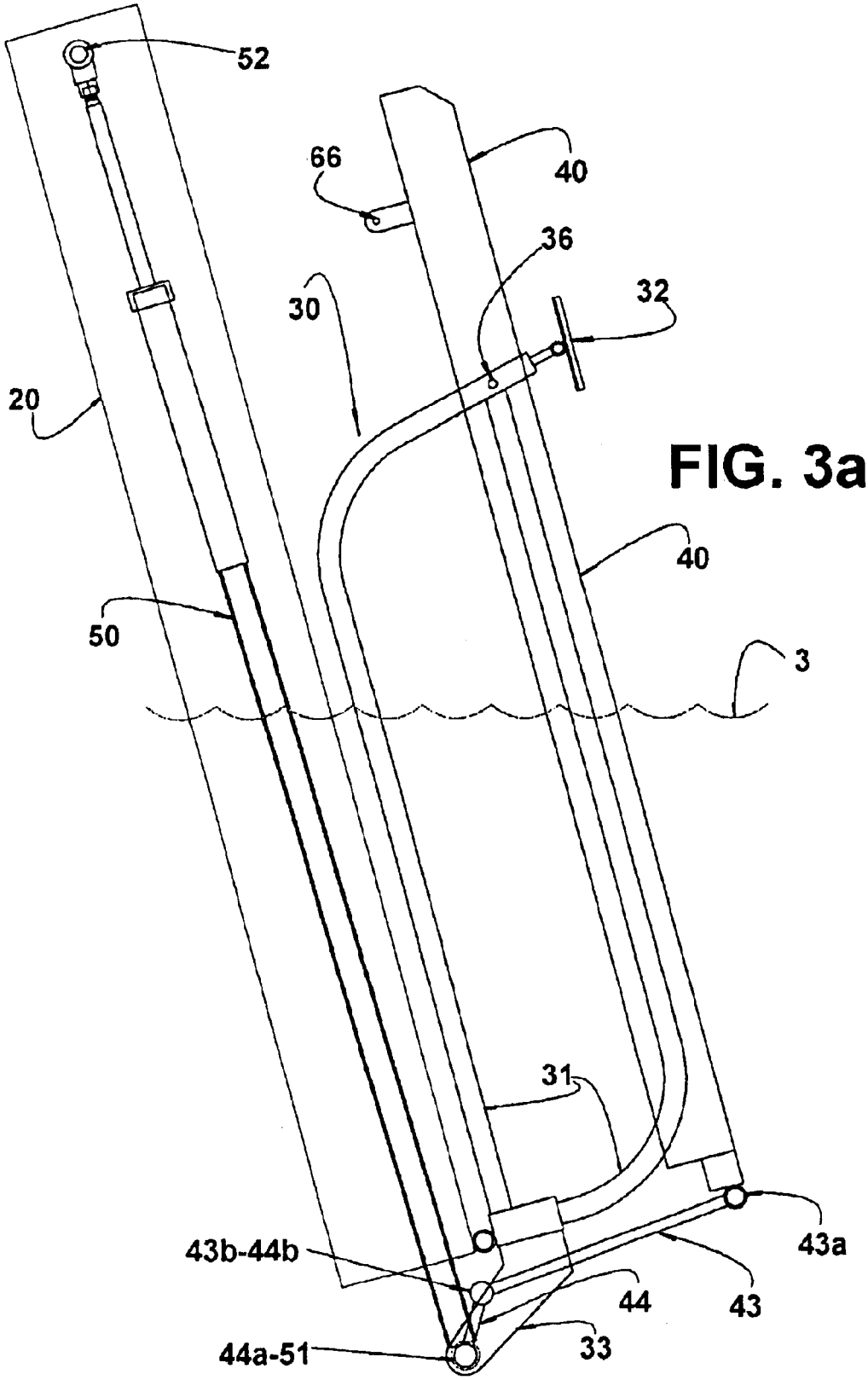
FIG. 3*a* is an enlarged schematic lateral view of the structural arm, illustrating the positioning of the chassis actuator and its connection to the structural arm and to the chassis of the treadmill, with the chassis of the treadmill being in the inoperative position illustrated in FIG. 3.
Figure 4:
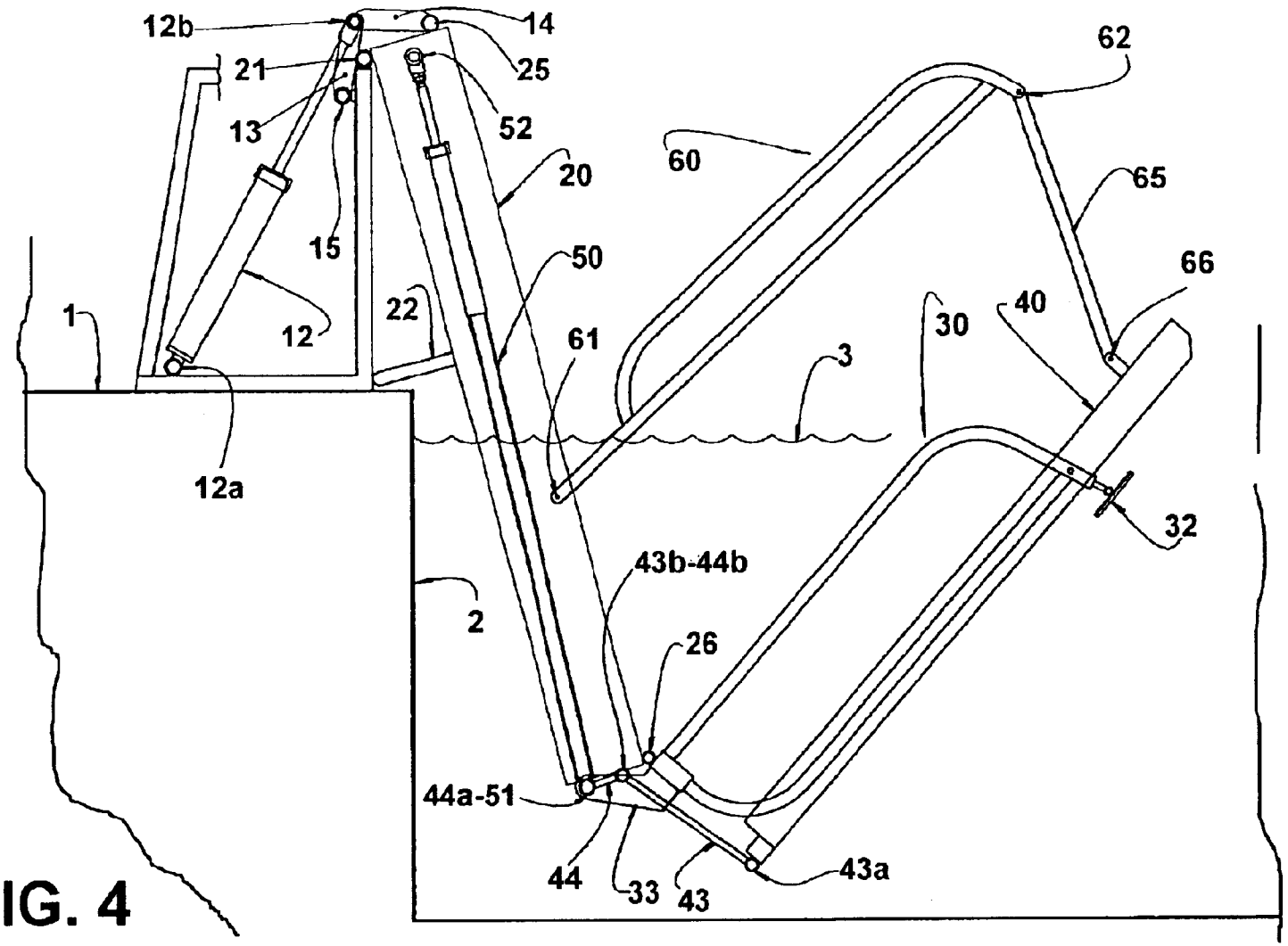
FIG. 4 is a view similar to that of FIG. 3, but illustrating the chassis of the treadmill in an intermediate position.
Figure 4A:
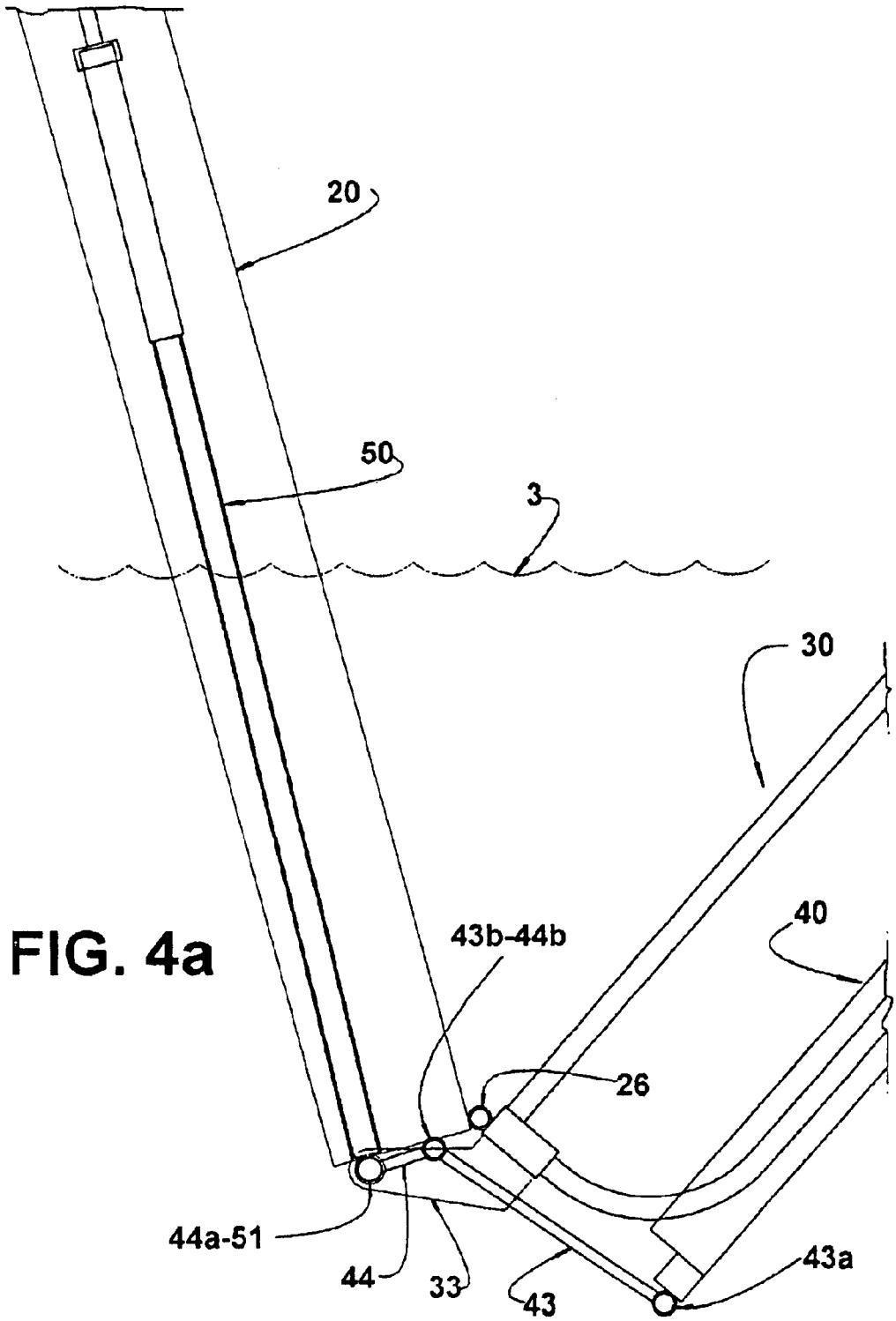
FIG. 4*a* is an enlarged schematic lateral view of the structural arm, illustrating the positioning of the chassis actuator in the operative position of the treadmill illustrated in FIG. 4.

The activation of the structural arm 20 provokes, through the second rod 14, the angular displacement of the structural arm 20 around its hinge means 21 coupled to the base 10, and the opposite end 12*b* of the arm actuator 12 describes a circular trajectory around the coupling means 15 that connects the first rod 13 to the base 10, said first rod 13 being medianly seated against the hinge means 21 of the structural arm 20, operating also as a stop of the latter, when it reaches the operative position, as illustrated in FIG. 3.

Figure 5:
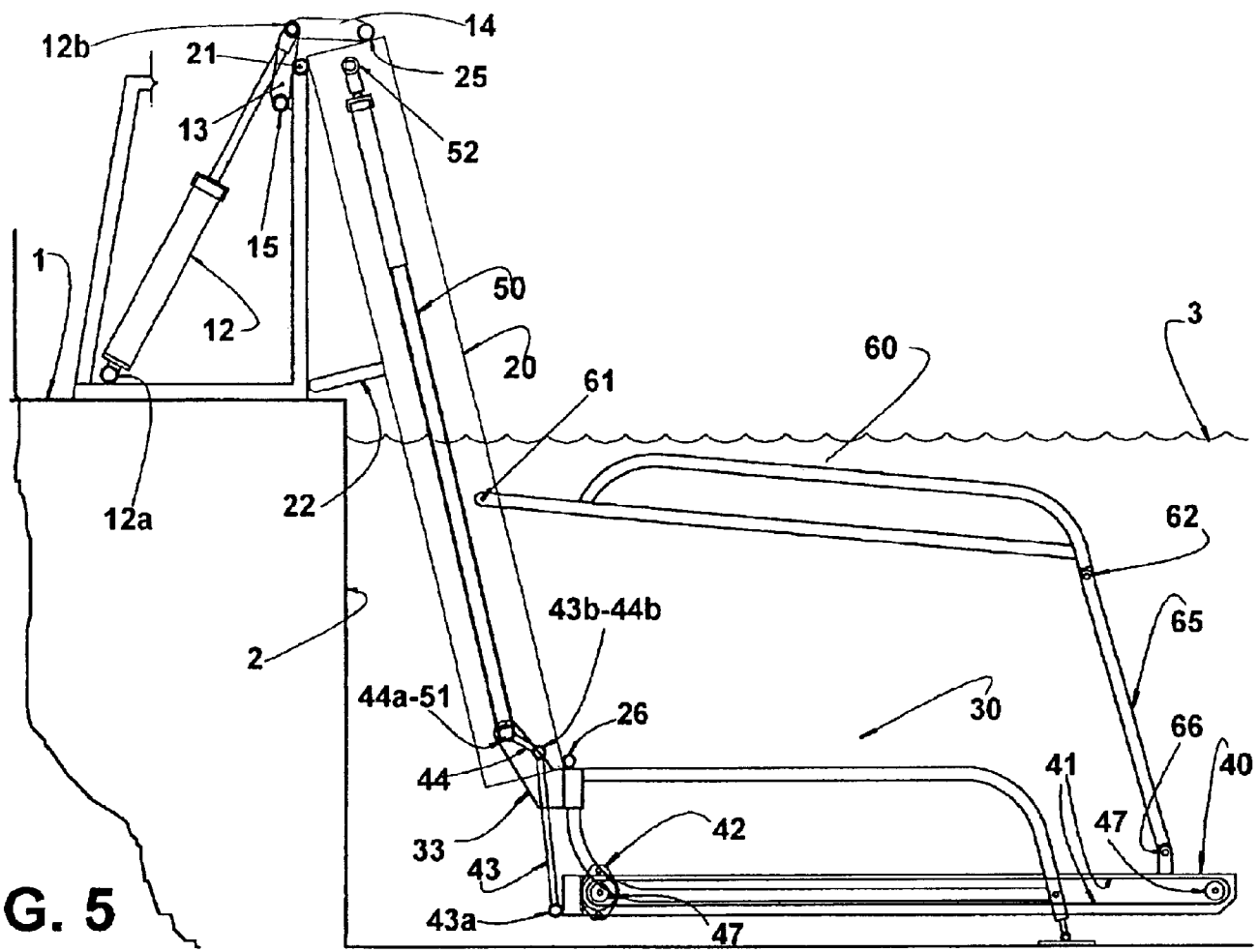
FIG. 5 is a lateral view of the treadmill of FIG. 4, but illustrating the chassis of the treadmill in the totally submersed operative position.
Figure 5A:
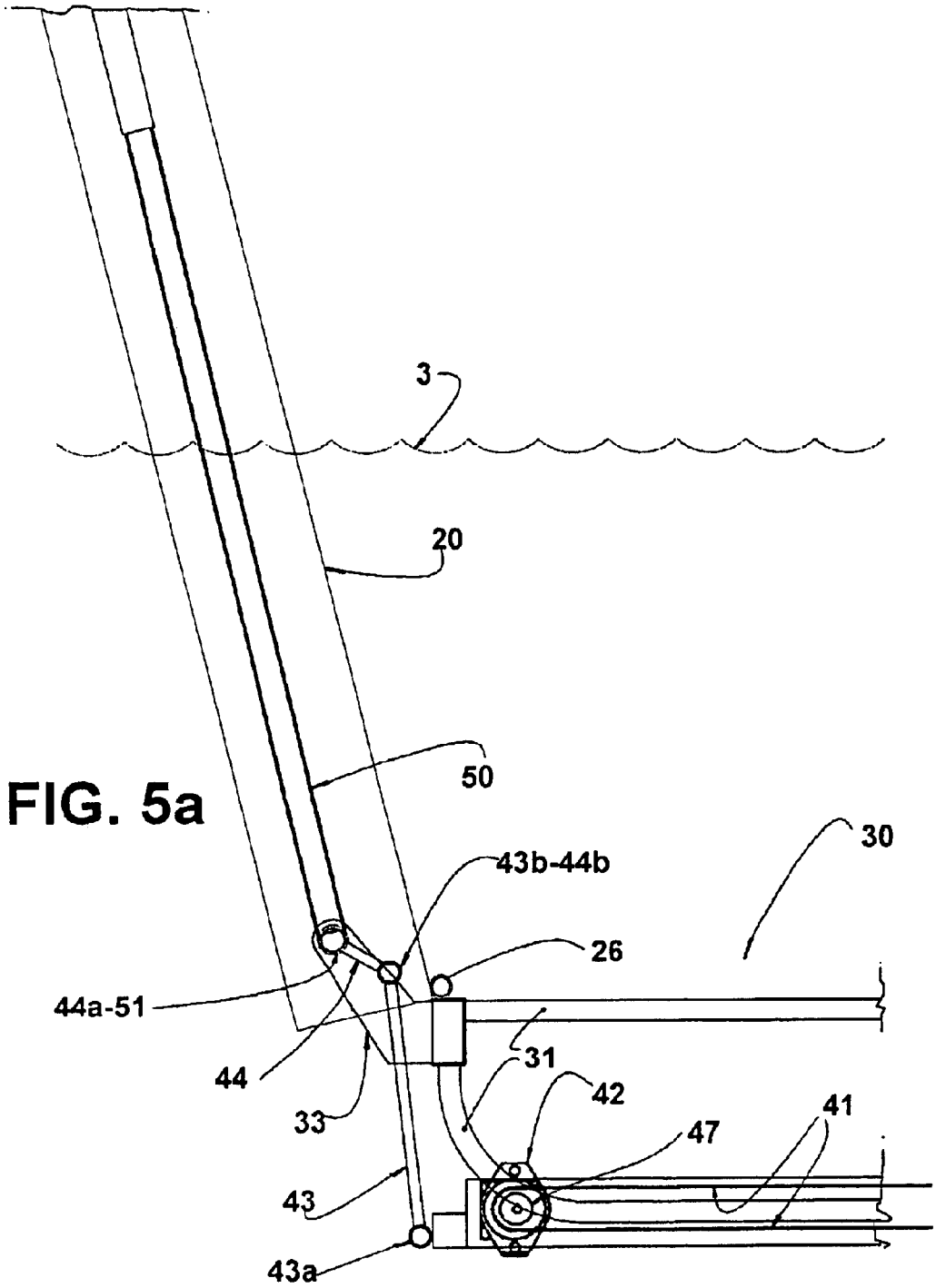
FIG. 5*a* is a view similar to those of FIGS. 3*a* e 5*a*, but illustrating the chassis actuator in the operative position of the treadmill illustrated in FIG. 5.
Figure 6:
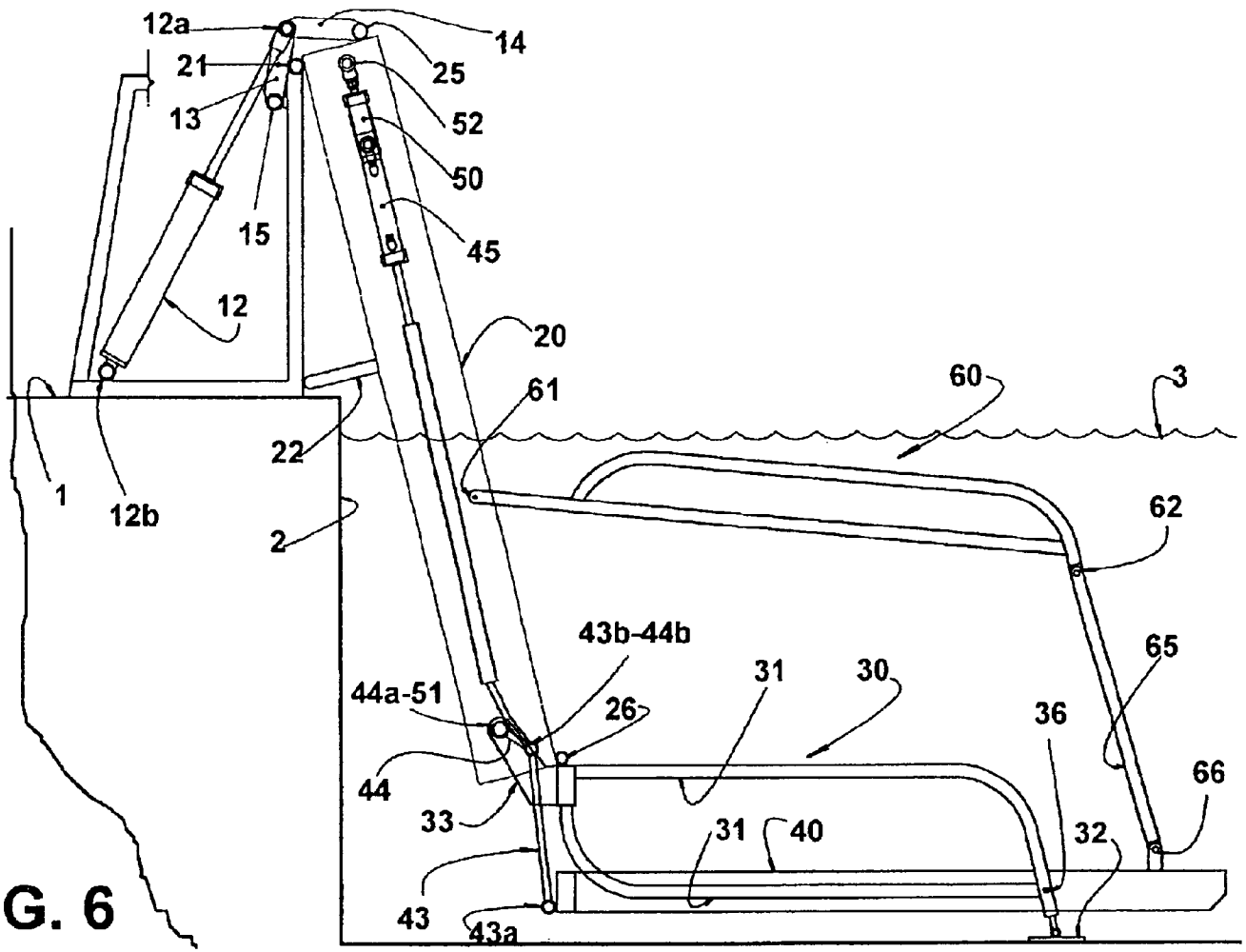
FIG. 6 is a view similar to that of FIG. 5, but illustrating the chassis actuator and the inclination actuator mounted to the structural arm and with the belt lying in a horizontal position.
Figure 6A:
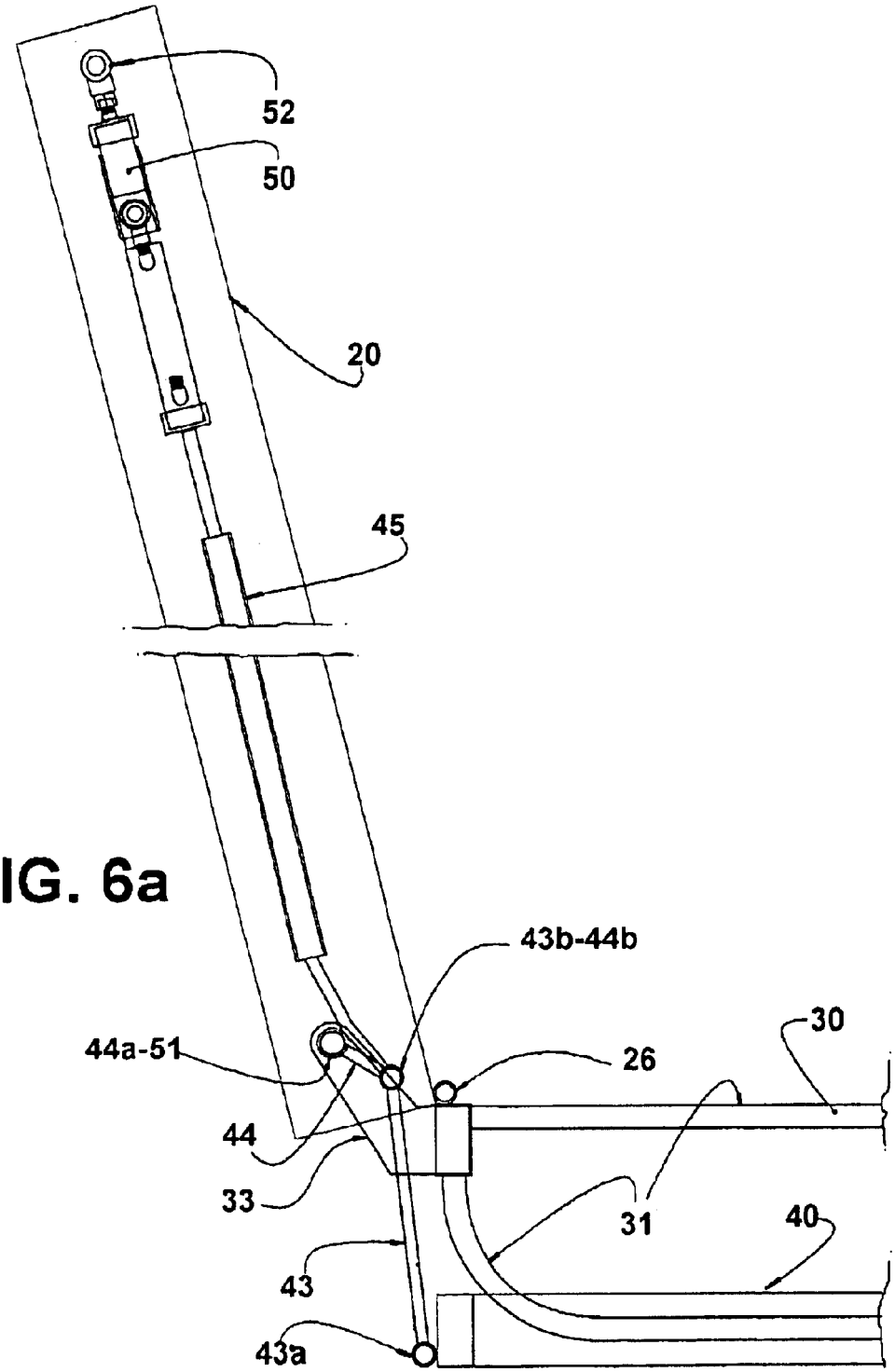
FIG. 6*a* is an enlarged lateral view of the structural arm and of part of the chassis of the treadmill, as illustrated in FIG. 6.

In the region of the free end of the structural arm 20 there is coupled, through a hinge 26, one of the ends of a chassis 30 comprising a pair of lateral frames 31 and having the other end inferiorly provided with a pair of shoes 32 (only one is illustrated), whose height is adjustable as a function of the depth of the swimming pool 2 and which will be seated on the bottom of the latter when the treadmill is taken to the operative position illustrated in FIGS. 5, 6, and 7. The first end of the chassis 30 secures a lever arm 33, which projects beyond the hinge 26, so as to have a free end articulated to a movable end 51 of a chassis actuator 50, usually defined by a hydraulic piston and having the fixed end 52 articulated in a region of the structural arm 20, close to the hinge means 21 of the latter. With this arrangement, the activation of the chassis actuator 50, in one or in an opposite direction, causes the angular displacement of the lever arm 33-chassis 30 assembly around the hinge 26 of the structural arm 20, allowing the chassis 30 to be angularly displaced between an inoperative position, seated against the structural arm 20, and a substantially horizontal operative position, in which the shoes 32 are seated on the bottom of the swimming pool 2.

The present aquatic treadmill is further provided with a pair of lateral bars 60 (only one is illustrated) to be grasped by the user's hands, each lateral bar 60 having an end 61 articulated to the structural arm 20 and an opposite end 62 articulated to the upper end of a respective column 65, whose lower end 66 is articulated to a respective side of a support frame 40 which, in the illustrated embodiment, has an end portion transversely pivoted to the chassis 30 in the region above the shoes 32 and represented at 36.

The support frame 40 carries an endless belt 41 that is conventionally mounted on a pair of transversal end rollers 47 and to the end roller, adjacent to the structural arm 20, a hydraulic motor 42 is coupled.

The end portion of the support frame 40, opposite to that adjacent to the pivoting to the chassis 30, is articulated to a first end 43*a* of a rigid rod 43, whose second end 43*b*, opposite to the first end, is articulated to a free end 44*b* of a small rigid arm 44, having another end 44*a* articulated to the lever arm 33 of the chassis 30, exactly at the same point of articulation of the respective end 51 of the chassis actuator 50.

The free end 44*b* of the small rigid arm 44 and the second end of the rigid rod 43 are jointly articulated to a movable end 45*a* of an inclination actuator 45, whose fixed end 45*b* is articulated to the movable portion of the chassis actuator 50.

In the construction above, the inclination actuator 45 does not modify the inclination of the support frame 40 upon the activation of the chassis actuator 50. However, as illustrated in FIGS. 6 and 7, the activation of the inclination actuator 45 allows the free end of the support frame 40 to be angularly upwardly displaced, from the "zero" inclination position, illustrated in FIG. 6, to a maximum inclination position illustrated in FIG. 7, with the angular displacement of the support frame 40 being effected around its pivoting axis to the chassis 30, at 36.

Figure 8:
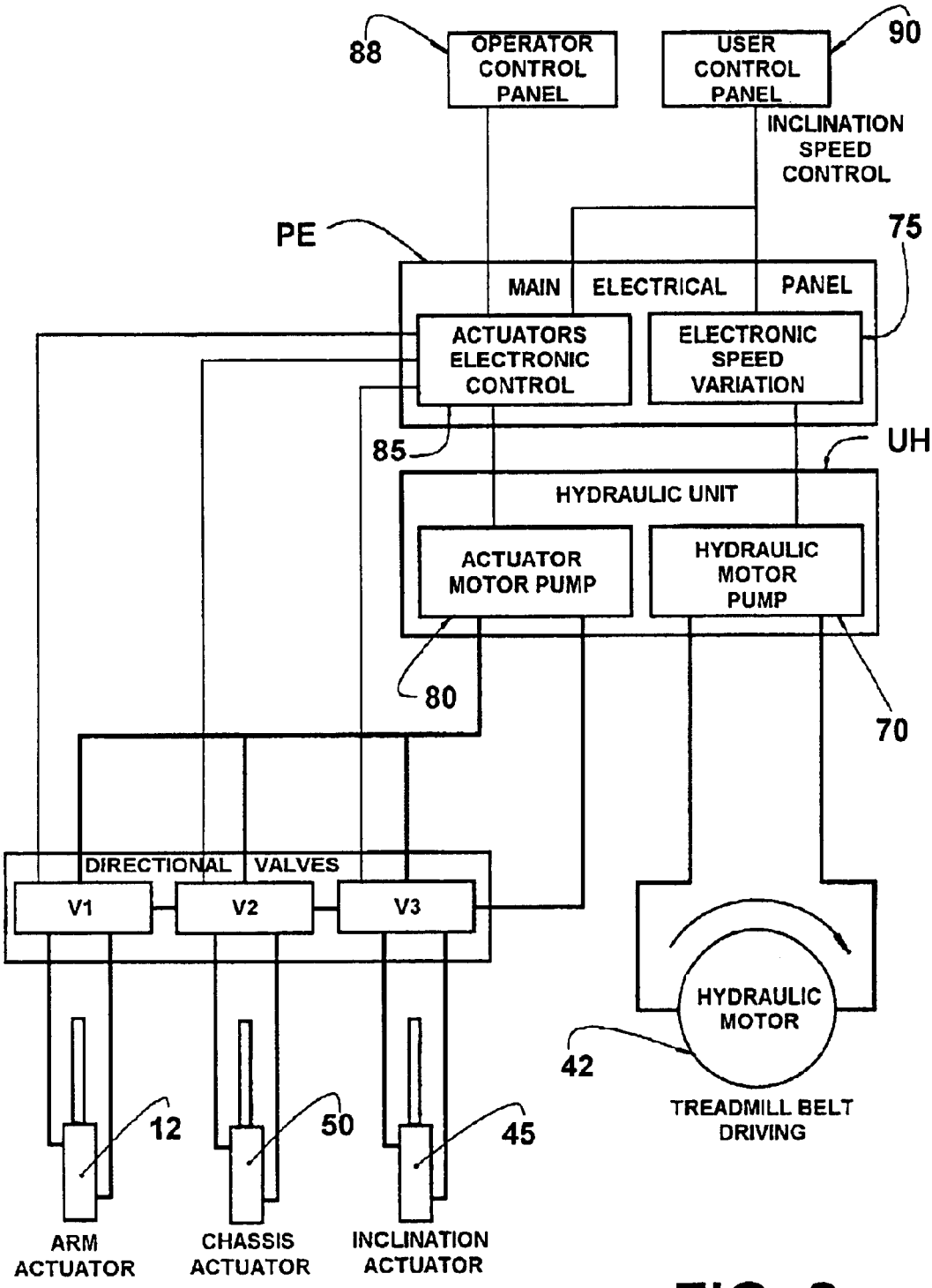
FIG. 8 is a block diagram, illustrating the actuators and the control means for the operation thereof.

The degree of inclination of the support frame 40 and consequently of the belt 41 mounted thereto is obtained by the activation of the inclination actuator 45, without occurring any alteration in the positioning of the chassis 30, which remains supported by the shoes 32 on the bottom of the swimming pool 2. FIG. 8 illustrates a possible construction for the actuators and control means of the treadmill.

As already mentioned, the belt 41 is driven, in a variable speed, by the hydraulic motor 42, which is hydraulically supplied by a first pump 70 that is preferably mounted in the interior of the base 10, jointly with a second pump 80, which supplies the arm actuator 12, the chassis actuator 50, and the inclination actuator 45, said first and second pumps defining a hydraulic unit UH, whose operation is commanded by a control means, to be described ahead. The hydraulic supply of the arm actuator 12, of the chassis actuator 50, and of the inclination actuator 45 is effected through respective directional valves V1, V2, V3 operatively associated with an actuator electronic control means 85, which is part of a main electric panel PE provided in a place close to that where the base 10 is installed, and the actuator electronic control means B5 is also operatively associated with the second pump 80 for controlling the operation of the latter.

The main electrical panel PE contains a speed variation electronic means 75, which is operatively associated with the first pump 70 and with the user control panel 90 to be usually accessed by the user to select the driving speed of the belt 41 and also the inclination to be imparted to the support frame 40 during the exercise. It should be noted that the user control panel 90 is further operatively coupled to the actuator electronic control means 85, in order to allow the user to select the desired inclination of the support frame 40, by actuating the directional valve V3 of the inclination actuator 45.

Figure 9:
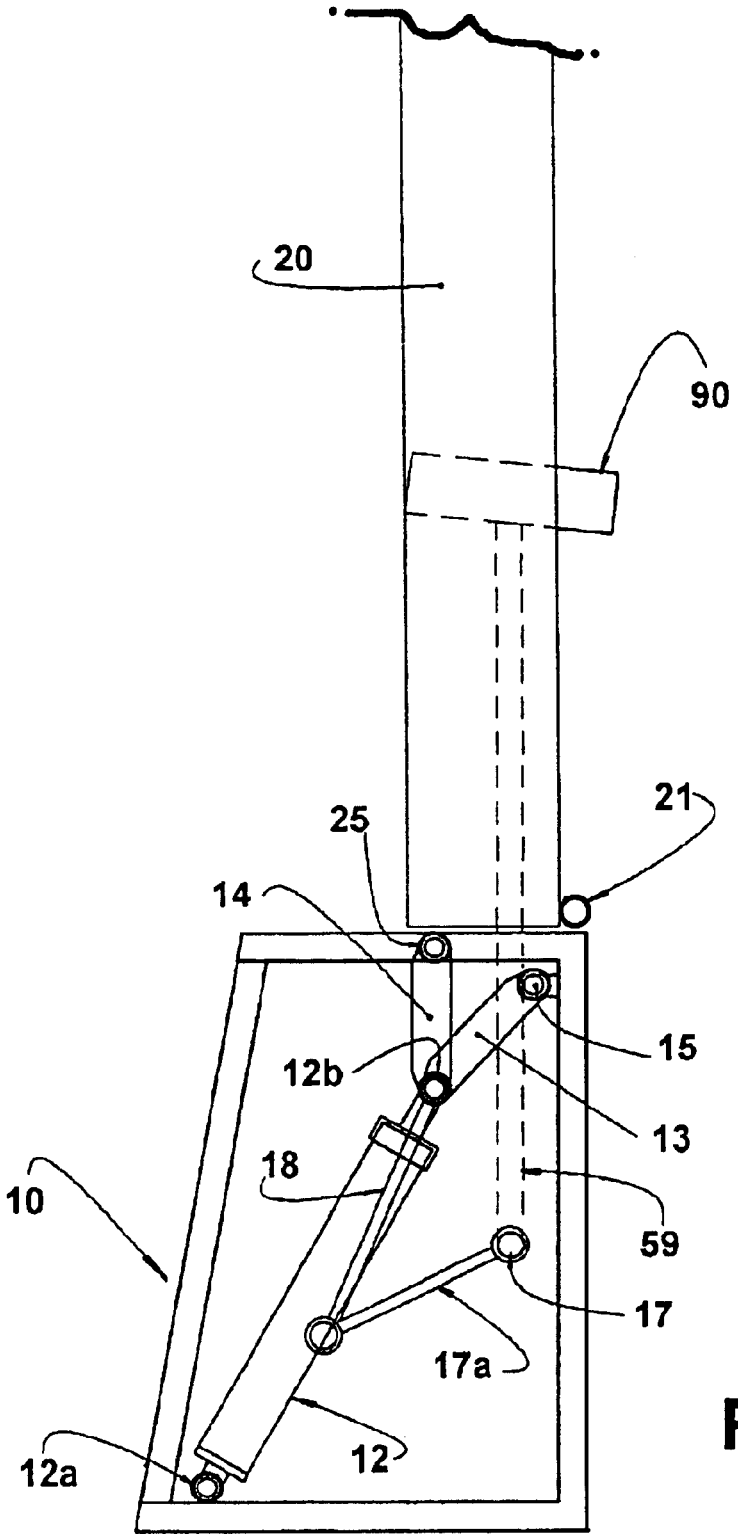
FIG. 9 is a partial lateral view of the treadmill of the invention, illustrating a system by which a user control panel 90 is mounted to the present apparatus and positioned when the treadmill is in its inoperative position illustrated in FIG. 3.
Figure 9A:
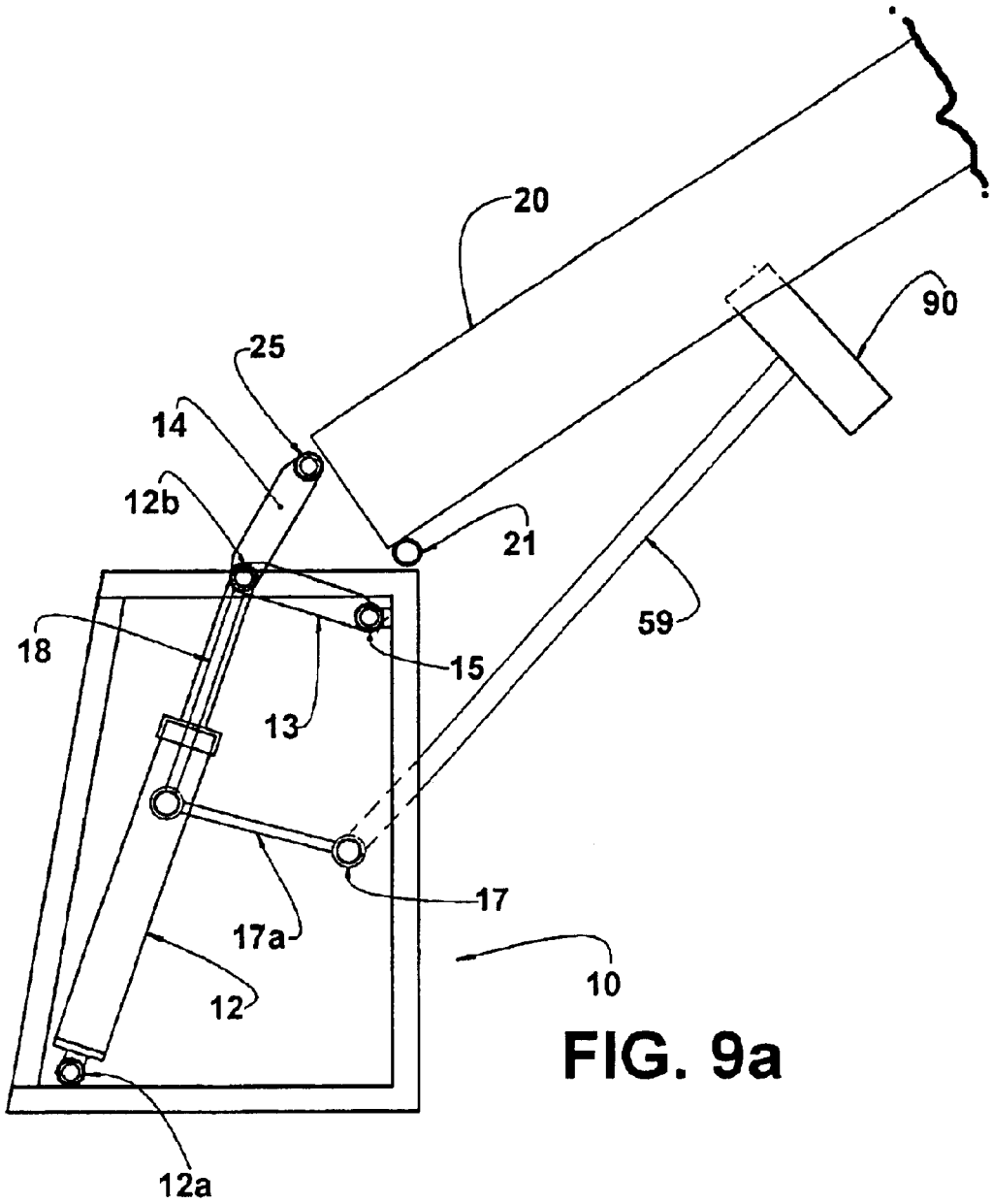
FIGS. 9*a* and 9*b* are views similar to that of FIG. 9, but illustrating the user control panel in an intermediate position and in an operative position, corresponding to the treadmill positions illustrated in FIGS. 2 and 5, respectively.
Figure 9B:
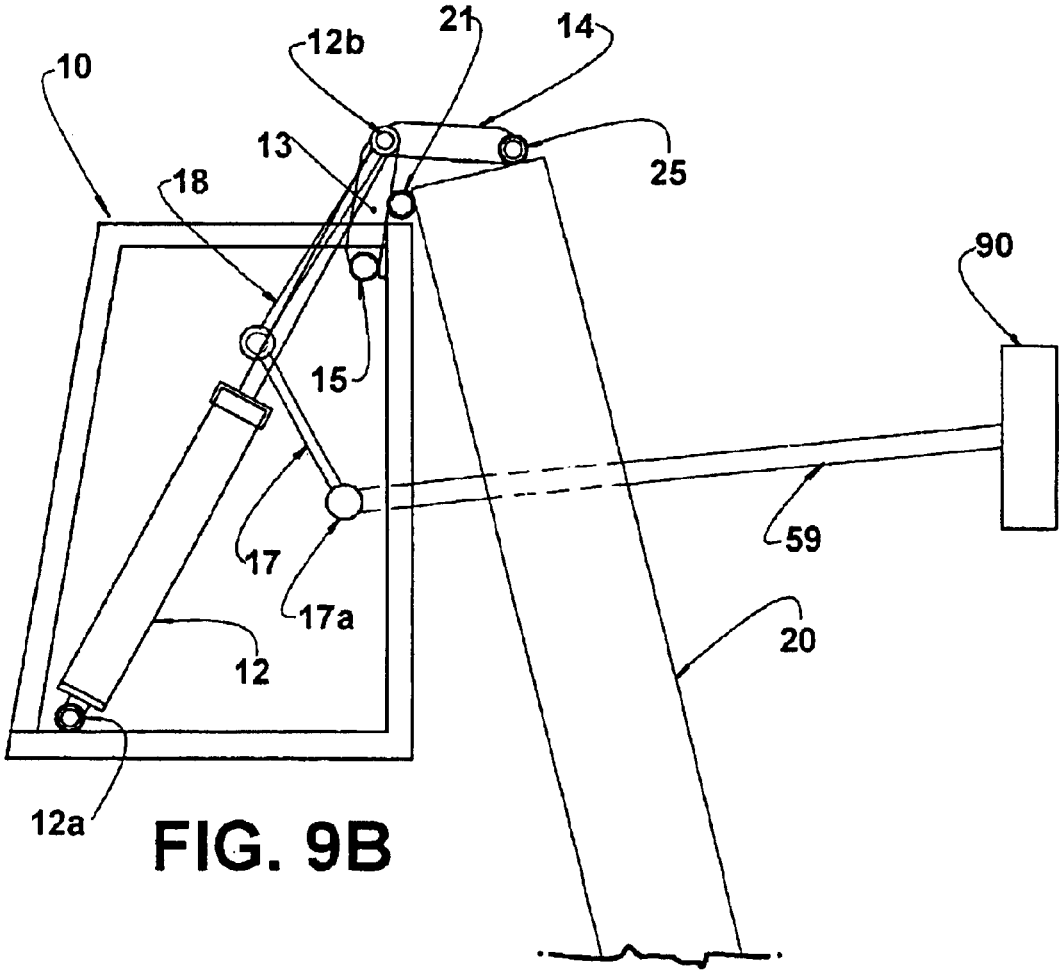

The user control panel 90 can be mounted to the free end of an arm 59, whose basic end can be coupled to the base 10 or to the structural arm 20 itself, so as to be moved to an operative position located above the body of water 3 and above the support frame 40 in an accessible condition to the user already in the upright position on the belt 41, as illustrated in FIG. 9*b*.

In the illustrated construction, the arm 59 of the user control panel 90 has its basic end articulated by a shaft 17, horizontally journalled to the base 10 and fixed to an end of a radial arm 17*a* having the free end articulated to a free end of a free end of a driving arm 18 which basic end is articulated to the opposite end 12*b* of the arm actuator 12, in which opposite end 12*b* are simultaneously articulated the respective ends of the first and second rods 13, 14. With the assembly above mentioned, the displacement of the structural arm 20, by the arm actuator 12, between the inoperative position, in which the structural arm 20 is positioned above and outside the area of the body of water 3, produces an angular displacement of the arm 59 of the user control panel 90 in about ninety degrees, between the inoperative and operative positions, as illustrated in FIGS. 9, 9*a* and 9*b*.

The actuator electronic control means 85 is further operatively associated with an operator control panel 88, through which the commands for the actuation of the arm actuator 12 and the chassis actuator 50 are given, upon the movements of the aquatic treadmill between its inoperative and operative positions.

The hydraulic fluid is forced to circulate, between the different components of the assembly, in the interior of hoses having an adequate known construction and which are not illustrated, since they do not belong to the present invention.

There is no electric supply to any part of the treadmill in contact with the body of water 3. The electric supply of the user control panel 90 is effected with minimum voltage, offering no risk to the user.

Figure 1:
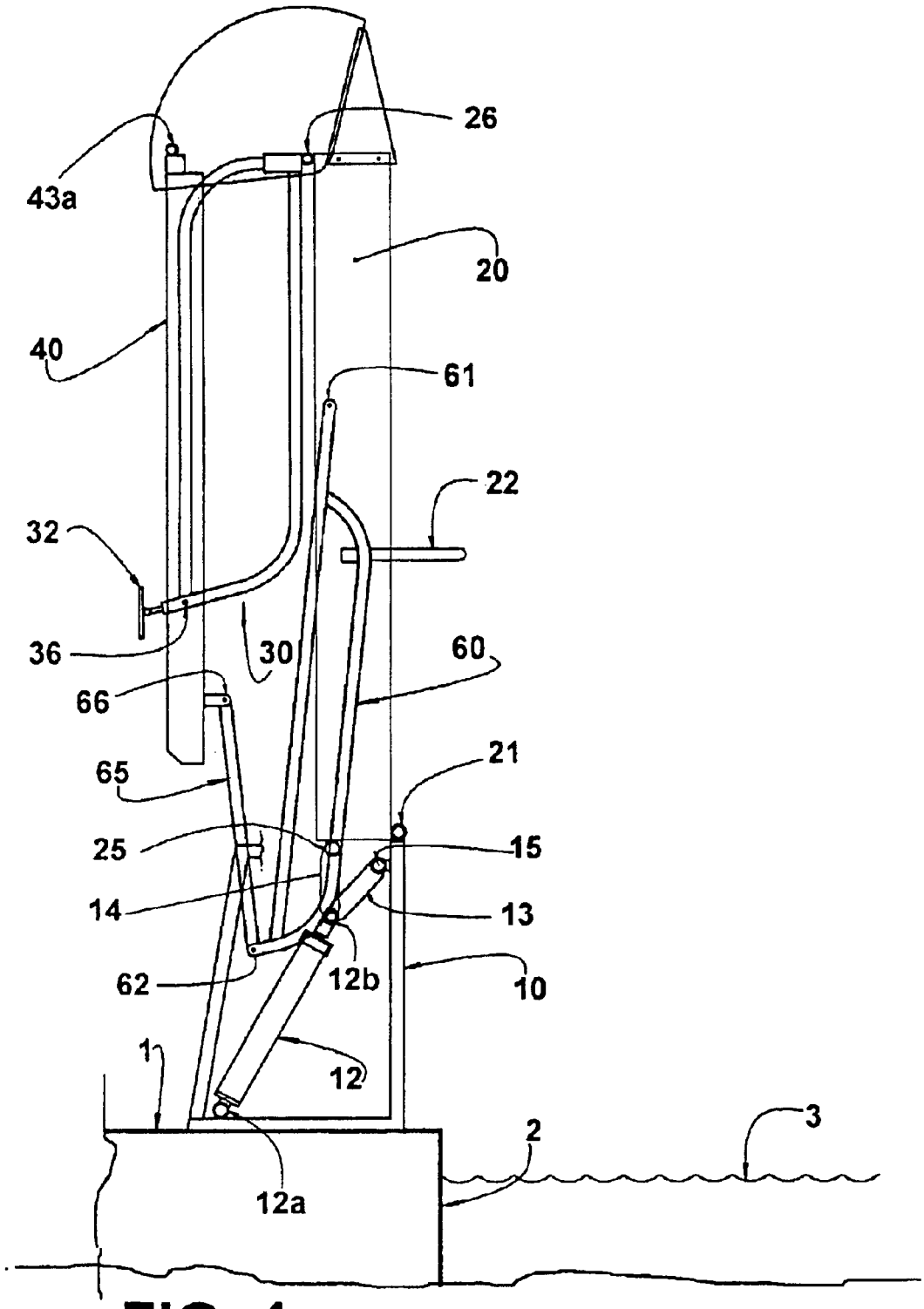
FIG. 1 is a schematic lateral view of the treadmill of the present invention, mounted on the edge of a swimming pool and maintained in an inoperative position, with the structural arm being totally raised.
Figure 2:
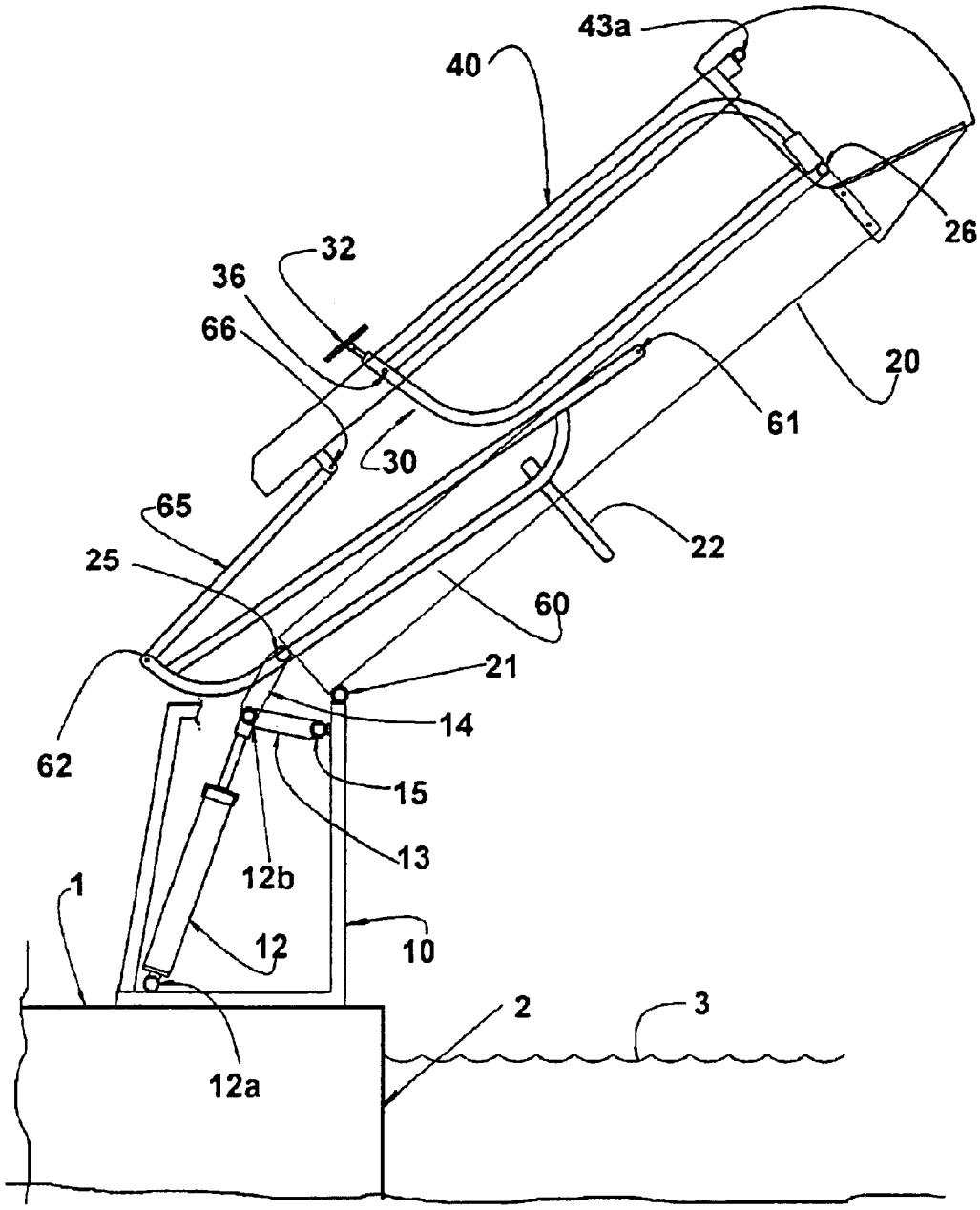
FIG. 2 is a view similar to that of FIG. 1, but illustrating the treadmill in an intermediate position, with the structural arm still out of the water during its displacement between the inoperative position and the operative position.

When the aquatic treadmill is in the inoperative condition illustrated in FIG. 1, its operation is started with a command in the user control panel 88, to allow the structural arm 20 to initiate its angular displacement to the operative position illustrated in FIG. 3 by actuation of the arm actuator 12.

When the structural arm 20 reaches its operative position after a predetermined time sufficient for the treadmill to be moved from the inoperative to the operative position, an arm position inductive sensor (not illustrated) informs the actuator electronic control means 85 to command the activation of the chassis actuator 50, provoking the displacement of the latter to the substantially horizontal operative position, illustrated in FIGS. 5, 6, e 7, seated on the bottom of the swimming pool 2.

When the chassis 50 reaches an operative position, after said time necessary for displacement of the treadmill has elapsed a chassis position inductive sensor (not illustrated) informs the actuator electronic control means 85, indicating that the treadmill has finished its displacement, allowing the shut-off of the respective hydraulic pump 80.

Then, the user may step on the belt and activate, through the user control panel, the hydraulic motor 42 and select the desired speed to run the belt 41. The user may also select, in the same user control panel 90, the desired inclination for the belt 41, varying the inclination of the support frame 40 by means of the inclination actuator 45.

The electronic control system is designed to prevent the arm actuator 12 and the chassis actuator 50 from being activated while the belt 41 is operating, thus guaranteeing the safety of the user performing exercises in the equipment.

At the end of the exercise and with the hydraulic motor 42 being deactivated by the user, through the user control panel 90, the user leaves the belt 41 and the operator control panel 88 is then reactivated to allow the actuator electronic control means 85 to command the reverse activation of both the arm actuator 12 and the chassis actuator 50, bringing the assembly to its resting inoperative position, by actions which are the reverse of those ones disclosed for displacement of treadmill to the operative position.

While only one embodiment of the present aquatic treadmill has been illustrated, it should be understood that changes could be made in the component parts thereof, without departing from the scope of protection defined by the appended claims.

What is claimed is:

1. An aquatic treadmill to be submersed in a swimming pool (2) containing a body of water (3) in a predetermined level, characterized in that it comprises:

a base (10) affixed to the edge (1) of the swimming pool (2), externally to the area occupied by the body of water (3);

an structural arm (20) having a mounting end articulated to the base (10), in order to be selectively and angularly displaced between an inoperative position, elevated and external to the area occupied by the body of water (3), and an operative position, in which it is downwardly projected, so as to have a free end penetrating into the body of water (3);

an arm actuator (12), which is simultaneously articulated to the base (10) and to the structural arm (20), in order to produce the angular displacement of the latter between its operative and inoperative positions;

an elongated chassis (30), having an end articulated to a free end of the structural arm (20), in order to be selectively angularly displaced between an inoperative position, seated against the structural arm (20), and a substantially horizontal operative position;

a chassis actuator (50), which is simultaneously articulated to the structural arm (20) and to the chassis (30), in order to produce the angular displacement of the latter between its operative and inoperative positions;

a support frame (40) mounted to the chassis (30) and carrying a pair of end transversal rollers (47), around which an endless belt (41) is mounted.

2. An aquatic treadmill, according to claim 1, characterized in that the chassis (30) is seated onto the bottom of the swimming pool (2) when in the operative position.

3. An aquatic treadmill, according to claim 2, characterized in that the chassis (30) is seated onto the bottom of the swimming pool (2) by means of shoes (32), with adjustable height and which can be mounted under the chassis (30).

4. An aquatic treadmill, according to claim 1, characterized in that the chassis actuator (50) has a fixed end (52) articulated in a region of the structural arm (20) close to its articulation to the base (10), and a movable end (51) articulated to a free end of a lever arm (33) that projects from the chassis (30) beyond its hinge (26) to the structural arm (20).

5. An aquatic treadmill, according to claim 4, characterized in that the support frame (40) has an end portion that is transversally pivoted (36) to the chassis (30), so as to be selectively and angularly displaced between a horizontal position of "zero" inclination and a maximum inclination position.

6. An aquatic treadmill, according to claim 5, characterized in that the support frame (40) presents an end portion, opposite to that pivoted to the chassis (30), the angular displacement of the support frame (40) being achieved by an inclination actuator (45) having a movable end **(45*a*) articulated to said end portion of the support frame (40) and a fixed end articulated to the chassis actuator (50)** so as to move with the latter.

7. An aquatic treadmill, according to claim 6, characterized in that the angularly movable end portion of the support frame (40) is articulated to a firs end **(43*a*) of a rigid rod (43) whose second end (43*b*), opposite to the first one, is articulated to a free end (44*b*) of a small rigid arm (44), having another end (44*a*) articulated to the lever arm (33) of the chassis (30), in the same hinge of the movable end (51) of the chassis actuator (50), the free end (44*b*) of the small rigid arm (44) and the second end (43*b*) of the rigid rod (43) being articulated to the movable end (45*a*) of the inclination actuator (45)**.

8. An aquatic treadmill, according to claim 1, characterized in that it comprises a pair of lateral bars (60) to be grasped by the user's hands, each lateral bar (60) having an end (61) articulated to the structural arm (20) and an opposite end (62) articulated to the upper end of a column (65), whose lower end (66) is hinged to a respective side of the support frame (40).

9. An aquatic treadmill, according to claim 1, characterized in that the end transversal roller (47), adjacent to the structural arm (20), is coupled to a hydraulic motor (42) so as to be rotatively driven by the latter.

10. An aquatic treadmill, according to claim 9, characterized in that it comprises a first hydraulic pump (70) to supply the hydraulic motor (42) and a second hydraulic pump (80) to supply the arm actuator (12), the chassis actuator (50), and the inclination actuator (45) by means of respective directional valves (V1, V2, V3), said hydraulic pumps being mounted external to the body of water (3) of the swimming pool (2).

11. An aquatic treadmill, according to claim 10, characterized in that the operation of the first hydraulic pump (70) is commanded by a speed variation electronic means (75) operatively associated with the user control panel (90).

12. An aquatic treadmill, according to claim 11, characterized in that the user control panel (90) is operatively associated with the actuator electronic control means (85), to allow the user to command the activation of the inclination actuator (45).

13. An aquatic treadmill, according to claim 12, characterized in that the user control panel (90) is fixed to the free end of an arm (59) having a basic end articulated to the base (10) and operatively associated to the arm actuator (12), in order to be angularly displaced by the latter, between an inoperative position, in which it is displaced upwardly and outwardly of the area of the body of water (3), and an operative position in which it is positioned above the body of water (3) and above the support frame (40).

14. An aquatic treadmill, according to claim 12, characterized in that the second hydraulic pump (80) and the directional valves (V1, V2, V3) have their operation commanded by an actuator electronic control means (85) which is operatively associated with an operator control panel (88).

* * * * *